US005188558A

United States Patent [19]

Barton et al.

[11] Patent Number: 5,188,558

[45] Date of Patent: Feb. 23, 1993

[54] SELF-SEALING REFILLABLE PLASTIC BALLOON VALVE

[76] Inventors: Leslie W. Barton, 2818 Westridge, Carrollton, Tex. 75006; Andrew J. Barton, 7885 Seawall, Huntington Beach, Calif. 92648

[21] Appl. No.: 787,772

[22] Filed: Nov. 6, 1991

Related U.S. Application Data

[63] Continuation-in-part of Ser. No. 636,766, Jan. 2, 1991, abandoned.

[51] Int. Cl.[5] ..... A63H 27/10

[52] U.S. Cl. ..... 446/224; 446/220; 446/222

[58] Field of Search ..... 446/220, 221, 222, 223, 446/224, 225, 226; 137/223, 246, 843, 844, 846, 850, 853

[56] References Cited

U.S. PATENT DOCUMENTS

| | | | |
|---|---|---|---|
| 563,287 | 7/1896 | Lane et al. | 446/224 |
| 1,008,641 | 11/1911 | Gregory | 446/224 |
| 4,516,949 | 5/1985 | Schwartz | 446/222 |
| 4,547,168 | 10/1985 | Blacksberg et al. | 446/222 |
| 4,560,360 | 12/1985 | Isaacs et al. | 446/222 |
| 4,674,532 | 6/1987 | Koyanagi | 446/224 X |
| 4,842,007 | 6/1989 | Kurtz | 446/220 X |
| 4,917,646 | 4/1990 | Kieves | 446/224 |
| 5,017,254 | 5/1991 | Noguchi | 446/220 X |

*Primary Examiner*—Robert A. Hafer
*Assistant Examiner*—Sam Rimell
*Attorney, Agent, or Firm*—L. Dan Tucker

[57] ABSTRACT

The present invention relates to a self-sealing refillable plastic balloon valve produced from at least two sheets of plastic film of equal size and shape, cut and heat sealed to form an elongated plastic fill having an operable channel between an inlet and outlet end. The elongated plastic fill valve being affixed to a plastic balloon stem interior and being capable of cyclic self-sealing and reinflation operation of the balloon body. The plastic balloon valve which is capable of multiple self-sealing and refilling cycles, functions through the use of internal self-sealing means either singly or in combinatoin. The self-sealing refillable plastic balloon valve is mounted within a balloon neck with the outlet end extending into the body of the balloon. During assembly of the balloon, the valve can be mounted within the neck in a manner such that the heat bonding does not close the interconnecting channel from inlet to outlet ends of the valve. Optionally, the balloon valve can be inserted into the balloon neck after the manufacture of the balloon and bonded to the interior balloon neck creating a fixed relationship and a sealable balloon neck to valve combination once the valve self-seals.

10 Claims, 3 Drawing Sheets

SELF-SEALING REFILLABLE PLASTIC BALLOON VALVE

This is a continuation-in-part of co-pending application Ser. No. 07/636,766 filed Jan. 2, 1991, now abandoned.

BACKGROUND OF THE INVENTION

The present invention relates generally to a self-sealing, refillable plastic balloon valve suitable for inflatable assembly with balloons made from plastic sheet materials. The valve and balloon are bonded together to define an inflatable body providing a self-sealing and refillable assembly.

In another aspect, the invention relates to a self-sealing, reusable plastic balloon valve made from two or more flexible plastic sheets bonded together to define a valve inlet, a valve outlet, and a fluid channel which is self-sealing upon inflation of the balloon and removal of the fluid source. The self-sealing apparatus being adaptable for reuse and reopening for refilling or partial refilling of the plastic balloon.

Inflatable objects such as balloons or the like having an inflatable body and a neck extending therefrom, suffer from closure apparatus and procedures limitations. Sealing the openings through which the balloons are inflated has continued to present a problem, especially sealing means which allow reinflation or partial inflation of the balloon body after initially being filled and sealed. Attempts of sealing non-latex balloons of plastic sheet material have been to twist the ends of neck portions thereof following inflation and tying the twisted end with string. This procedure, while generally acceptable with latex or elastomeric balloons, has proven unsatisfactory with plastic sheet material constructed balloons with dimensionally stable neck inflation portions. Spring clips and other devices have been utilized in an effort to seal off the open ends of these non-elastomeric balloons. These clips are typically applied to the twist end of the balloons to pinch or squeeze the twisted end thereby to halt escape of gas. However, irrespective of the biasing force applied to the twisted end by the spring clips, channels have remained through which gases can gradually escape.

A number of plugs have been proposed for sealing the openings through which plastic film balloons are inflated. Some of these plugs are generally tapered and are intended to be simply forced into suitable valve openings following balloon inflation. Reliance on forced fits, however, have not proved satisfactory because of the difficulty of manufacturing processes and providing sufficiently close dimensional relationship.

Another approach has been to heat seal the open ends subsequent to inflation. While such sealing has reduced the amount of gas leakage, it has been inconvenient to use and has required heat sealing equipment which must be connected to power sources, reducing mobility. Also, the heat seals produced have not been satisfactory because such a final seal does not allow reentry for refilling or partially refilling the balloon, which will eventually deflate in part.

Popularity of plastic balloons or plastic inflatable toys having a body and an inflation stem has grown and continues to grow. This type of balloon includes two flexible plastic sheets which are heat sealed together in many different configurations. One or both of the sheets may be decorated or metalized to provide an aesthetically pleasing balloon. The term "balloon" as used herein refers to any inflatable toy or balloon having a body and an inflation stem. These balloons are generally impermeable, thus, sealing of the balloon stem is important and yet, it is also important to be able to refill the plastic body which, even under ideal sealing conditions, will slowly deflate.

Recently, the plastic balloon industry has sought to develop a self-sealing balloon and valve mechanism. The objectives have been reliability, minimum cost, ease of valve fabrication and simplicity of incorporation into the balloon stem and body. Several valves formed from two flexible plastic sheets have been made, but each suffers from one or more serous disadvantages. These disadvantages include unacceptably high failure rates, costly fabrication procedures or complexities of fabrication procedures, and difficulty in incorporating the valve insertion and adherence of the valve inside the balloon stem and body.

Self-sealing valves for use in conjunction with plastic balloons which are incorporated into the balloons during manufacture have been presented, for example, in U.S. Pat. No. 4,917,646 to Kieves. The valve of the Kieves '646 patent includes two flexible plastic valve sheets secured together to define a valve inlet, valve outlet, and valve passageway. One of the valve sheets extends beyond the other at the valve inlet to provide a positioning tab which substantially facilitates automation of the valve insertion process. The self-sealing valve fits entirely within the balloon with only a small portion positioned in the stem. During assembly of the balloon, the positioning tab and the valve inlet, which are located within the stem, are bonded or fused to the interior surfaces of the balloon sheets. Such positioning and manufacturing avoids potential valve damage and potential interference during inflation since there are no ends or edges of the self-sealing valve exposed to the inflation mechanism. One of the main disadvantages with the self-sealing valve in Kieves is its apparent unreliability in folding over to seal the valve passageway. The patent discloses that the floating portion of the sealing value "often partially folds over to crease the valve passageway." Evidently, there is no guarantee that the valve will seal by folding over every time. The unreliability of the self-sealing valve in Kieves is remedied by the present invention.

Additional assemblies have been presented which provide a device formed of sheet material having a body, with a neck terminating in a free end with an opening extending from the free end and communicating with the body which is capable of being inflated. Closure means have been provided inclusive of adhesive elements mounted on the neck and protruding or extending beyond the free end thereof, with the closure means adapted to be moved from an open position in which a tube extends into the neck such that the gas entering the device through the tube inflates the body, to a closed position in which the adhesive element which extends beyond the free end is sealed when the tube is removed from the device. The adhesive element when compressed is sealed together beyond the free end and the closure means is in its closed position so as to obtain a sealing of the neck to prevent gas from escaping therethrough. The adhesive element in these additional assemblies have a distinct disadvantage because the adhesive is designed to seal only once during the initial inflation of the balloon. The adhesive is not capable of properly sealing on reinflation of the balloon. In addition, the adhesive elements are sealed together only when compressed by some external force such as finger pressure exerted by the operator's hand.

The recent interest in development of a self-sealing balloon and valve mechanisms for plastic balloons and toys continues to experience negative functions such as the valve itself is exposed and subject to damage by puncture through engagement of the inflation mechanism, requirement of adapters for conventional pump mechanisms and the like. The valve sheets are frequently difficult to fully separate such that interference with the inflation process is experienced. In addition, most self-sealing valves are designed with primary focus on sealing and not on reinflation. These existing self-sealing valves are not generally satisfactory for example, based on valve construction material weakness and ease of reinflation or partial reinflation because of the self-sealing function.

SUMMARY OF THE INVENTION

The present invention relates to a self-sealing refillable plastic balloon valve produced from at least two sheets of plastic film of equal size and shape, cut and heat sealed to form an elongated plastic fill valve having an operable channel between an inlet and outlet end. The elongated plastic fill valve being affixed to a plastic balloon stem interior and being capable of cyclic self-sealing and reinflation operation of the balloon body. The plastic balloon valve which is capable of multiple self-sealing and refilling cycles, functions through the use of internal self-sealing means either singly or in combination. For example, crease or compression zone seals or adhesive seals capable of cyclic operations function to self-seal upon inflation of the balloon through back pressure force of the inflated balloon on the valve seal means when the inlet fluid pressure is removed.

The self-sealing refillable plastic balloon valve is mounted within a balloon neck with the outlet end extending into the body of the balloon. During assembly of the balloon, the valve can be mounted within the neck in a manner such that the heat bonding does not close the interconnecting channel from inlet to outlet ends of the valve. Optionally, the balloon valve can be inserted into the balloon neck after the manufacture of the balloon and bonded to the interior balloon neck creating a fixed relationship and a sealable balloon neck to valve combination once the valve self-seals.

According to the invention, the valve can be applied between two moving webs of plastic film before the balloon is produced through heat seal means. The valve is generally positioned through the length of the stem of the balloon as well as into the balloon cavity itself. The valve according to the invention solves many of the previous defects such as damage during inflation. Puncture damage caused by inflation mechanisms is avoided by using layered construction of sheets of polyethylene/nylon/polyethylene films which provide for a very tough, durable valve. The multi-layered polymeric materials also solve the problems of permeation through the valve material by the inflation fluid or gas since the laminated or layered polyethylene/nylon/polyethylene film construction provides an excellent gas barrier which is far superior to, for example, polyethylene construction only.

In one embodiment, a reusable adhesive coating can be applied to the interior channel of the valve which, when compressed together will seal the interior channel surfaces. The adhesive coating can be sealed and resealed to form a gas impermeable seal. The compression required to seal the surfaces together can be exerted by the filled fluid pressure inside the balloon upon withdrawal of full pressure from the valve.

It is an object of the present invention to provide a self-sealing plastic balloon valve capable of multiple self-sealing and opening, i.e., refilling cycles, which are suitable for various plastic balloon filling and refilling operations. Another object is to provide a plastic balloon valve with a reliable self-sealing and refilling valve capability. Yet another object is to provide a self-sealing valve for plastic balloons which may be readily incorporated into a balloon assembly process, or in the alternative, assembled after the balloon assembly process. Still another object of the present invention is an inexpensive, mass producible, self-sealing, refilling, cyclable balloon valve apparatus which may be fitted into any conventional balloon neck and body.

These and other features, objects and advantages of the present invention are implicit in the following detailed description.

BRIEF DESCRIPTION OF THE DRAWINGS

Several preferred embodiments of the present invention are described herein with reference to the drawings wherein.

Figure 3:
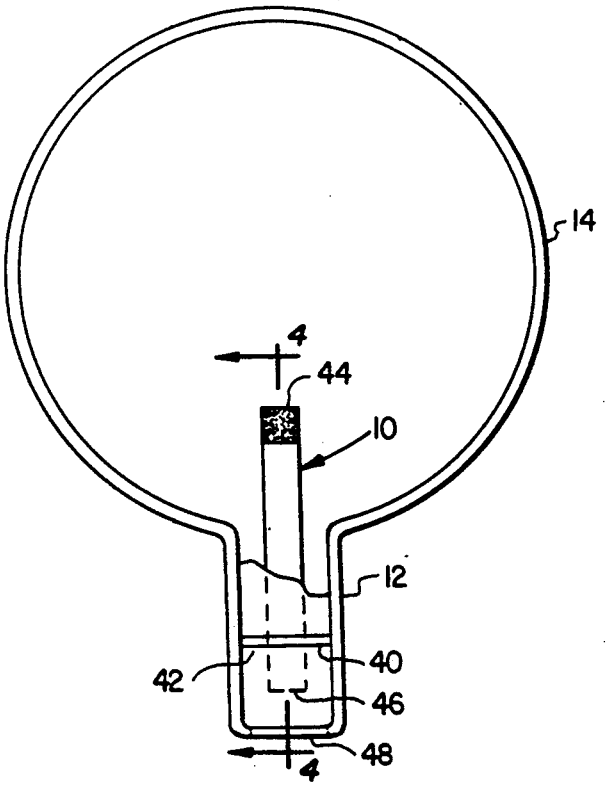
FIG. 3 is a top plane view of an inflatable assembly with the self-sealing, refillable plastic balloon valve showing an adhesive sealing means embodiment of the valve, along with valve to balloon neck seal means.
Figure 4A:
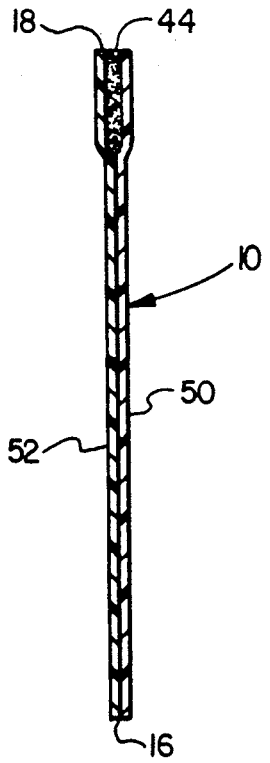
Figure 5:
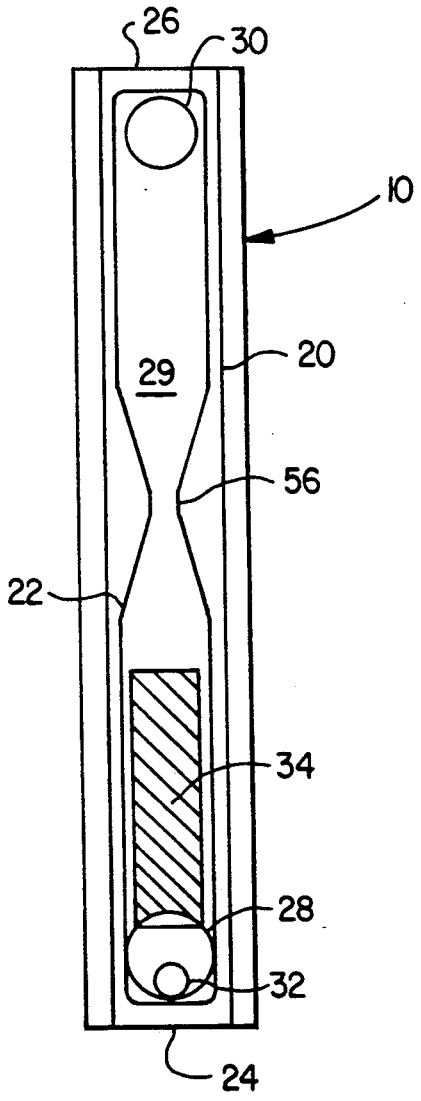

FIG. **4*a* is a cross-sectional view of the refillable plastic balloon valve of FIG. 3, taken along line 4—4** shown in isolation, the balloon valve in a closed, self-sealed position;

FIG. **4*b* is a cross-sectional view of the refillable plastic balloon valve of FIG. 4*a*, taken along line 4—4 shown in isolation with the channel between the inlet and outlet end of the valve being open for fluid flow; and FIG. 5** is a top view of yet another embodiment of the self-sealing, refillable plastic balloon valve, showing a valve body with a mid-portion tapered restriction zone which collapses and closes when the balloon is filled and the fluid source is removed from the valve inlet end.

Figure 6:
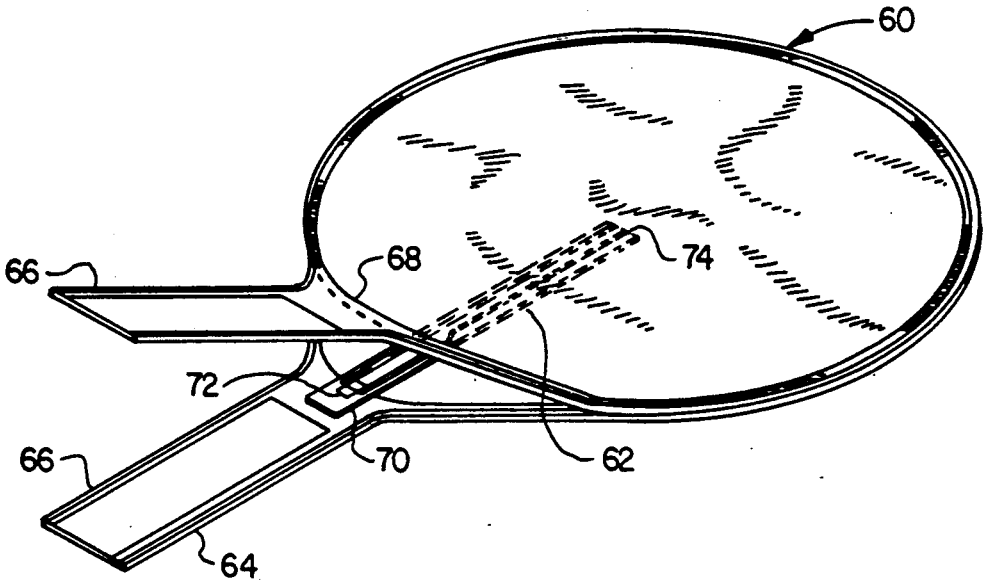
FIG. 6 (PRIOR ART)

FIG. 6 is a prior art apparatus in a perspective view showing a known self-sealing valve positioned within a non-latex balloon assembly, wherein the balloon stem is in a partially peeled-away position.

DETAILED DESCRIPTION OF THE INVENTION

Referring now specifically to the FIGURES in which identical or similar parts are designated by the same reference numerals throughout, a self-sealing, refillable plastic balloon valve is shown in a fragmental section view of an inflatable assembly or the valve in accordance with the present invention, is shown in isolation and is generally designated by the reference number 10.

Figure 1:
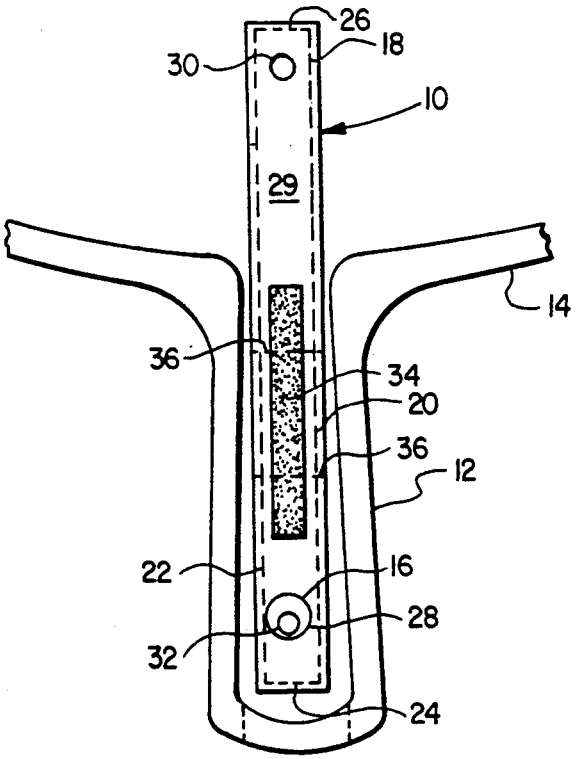
FIG. 1 is a fragmental section view of an inflatable assembly, showing a self-sealing, refillable plastic balloon valve in position in accordance with the present invention.

The elongated plastic fill valve 10 in FIG. 1 is sealably affixed inside a balloon neck portion 12 of balloon 14. The elongated plastic fill valve 10 has an inlet end 16 and an outlet end 18, the value 10 being constructed of at least two plastic film sheets which are heat sealed along sides 20 and 22 and along inlet portion 24 and outlet portion 26. The inlet end 16 has a hole 28 in a top layer sheet of the inlet end 16 which is in communication with hole 30 in the top layer sheet of the outlet end 18 through channel 29 defined by the elongated plastic fill valve 10.

Figure 2:
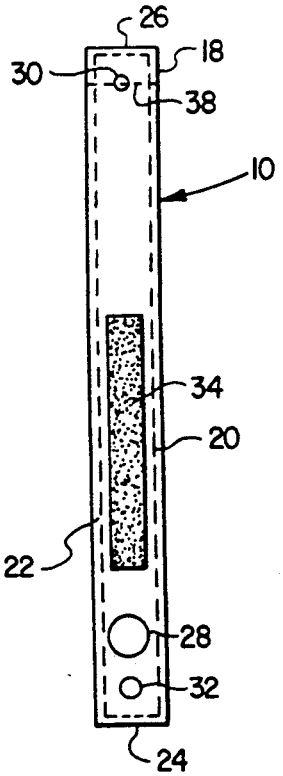
FIG. 2 is a top view of the valve of FIG. 1 in isolation, further showing a valve body crease sealing means and a modified inlet opening configuration.

A non-sealable coating 34 is positioned either on the bottom or top or both interior surfaces of the elongated plastic fill valve 10. The non-sealable coating 34 prohibits the sheet materials of the valve from sealing the channel 29 when heat seals or pressure seal means are applied to the valve 10 when inserted into the balloon 14 of neck portion 12 as indicated by valve to balloon seals 36. In FIG. 2, the valve of FIG. 1 in isolation, further shows a valve body crease 38 which collapses upon back pressure or compression exerted by the filled balloon when inflation pressure is removed. The collapsing of the crease at the outlet end 18 hole 30 creates a self-sealing position. In addition, FIG. 2 shows a different configuration of the inlet hole 28 in the inlet end and a string hole 32, which provides an opening through all layers of the balloon valve and balloon 14 neck portion layers.

In FIG. 3, the top plan view of an inflatable assembly, illustrates the elongated plastic fill valve 10 positioned and sealed inside the neck portion 12 of balloon 14 through valve to balloon seal 40–42. A self-sealing means is provided through adhesive coating 44 which is in the outlet end 18 of the elongated plastic fill valve 10. Adhesive coating 44 can be any type of reusable adhesives. For example, the reusable adhesives can be comprised of resin emulsion water-based adhesives. Preferably, adhesive 44 is a distilled monoglyceride-based adhesive, and more preferably, adhesive 44 is Myverol (a trademark used in conjunction with a monoglycinide adhesives). The elongated plastic fill valve 10 is further illustrated in an isolated cross-sectional view in FIG. 4A, which is taken along line 4—4 of FIG. 3. The valve 10 is shown in a closed position with adhesive 44 closing the outlet end of the elongated plastic fill valve 10 which shows in cross-section elongated plastic film 50 and elongated plastic film 52 which define the valve body.

Figure 4B:
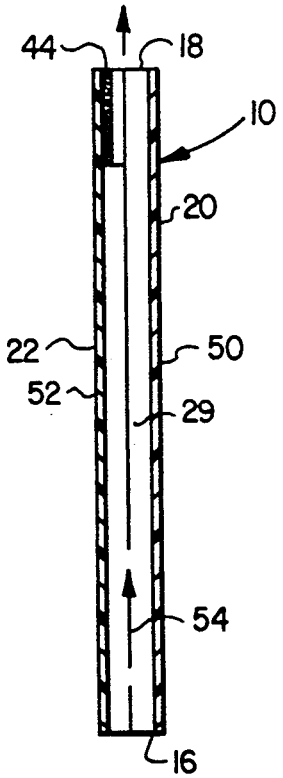

FIG. 4B is a cross-sectional view of the refillable self-sealing plastic balloon valve shown in FIG. 3 in isolation taken along the lines 4—4, wherein the elongated plastic fill valve 10 is in an open position with channel 29 being open from the inlet end 16 through the fluid channel passage 54 to outlet end 18. The adhesive 44 coating on plastic film 52 is positioned apart from the elongated plastic film 50, which results upon pressurized fluid channel passage flow of the inflation fluid entering inlet end 16. It will be appreciated that the adhesive coating can be applied to one or both the inside surfaces of the valve channel. The elongated plastic film 50 and elongated plastic film 52 are joined by heat seal 20 and heat seal 22, which along with adhesive 44, define a recyclable, self-sealing and reopening channel 29.

FIG. 5 is a top view of yet another embodiment of the refillable, self-sealing plastic balloon valve according to the invention, wherein the elongated plastic fill valve 10 has been heat sealed to form a zone of reduced cross-sectional opening 56 formed by a tapered restricted channel 29 at zone 56. When utilized in combination with a plastic balloon with the elongated plastic fill valve inserted into the balloon neck and sealed to the balloon neck, the zone of reduced cross-sectional opening 86 and the tapered restricted channel 29 at zone 56 create a self-sealing portion of the valve 10 when the balloon is filled and the inflating fluid source is withdrawn. Zone 56 is positioned either in the balloon neck or the balloon body. Either position allows for the collapsing back pressure compression action on channel 29 through the restricted channel zone 56 and die cut area zone 86.

A prior art self-sealing valve is shown in FIG. 6 through a perspective view and presents a valve balloon assembly wherein the valve to balloon positioning and bonding is through contact of the valve through a tab portion. One sheet of the balloon stem is shown in a partially peeled away position. The prior art assembly illustrates a balloon 60 with a valve body 62 mounted substantially within the balloon 60. A balloon stem 64 is defined by balloon sheets 66 which are in a peel-apart position showing a valve positioning tab 70 mounted in a zone near the balloon body within the balloon stem 64. The assembly has a valve inlet 72 and a valve outlet 74. As illustrated, the valve body 62 lies entirely within the balloon 60. A first portion of the valve body 60 extends into the balloon body and is substantially free or in a floating position therein. This floating portion 80 often partially folds over under pressure to crease the valve passageway 68. Since this valve does not have a zone of less mass, it is very difficult to determine whether the floating portion 80 will crease to adequately seal the valve passageway 68 and it is also difficult to tell exactly where the crease will occur. That portion of the valve that extends into the balloon stem 64 includes the valve positioning tab 70 and value inlet 72 and is bonded to the balloon stem 64 in the assembly of the balloon apparatus.

According to one embodiment of the present invention, a refillable and resealable adhesive plastic balloon valve is obtained by applying removable adhesive such as used on removable tape and labels to the inside of one or both sheets of plastic film, e.g., strip coating low density polyethylene film with removable adhesive, then heat sealing and diecutting the plastic sheets to form the desired shape and size of the valve. The valve is then heat sealed or otherwise applied to the plastic inflatable balloon. Upon inflation, the pressure of the gas (air, helium, etc.) forces the removable adhesive sheets to separate forming a channel allowing the gas to enter the balloon. At the time when the gas to the balloon is shut off the pressure inside the valve ceases or compresses, and the pressure inside the balloon along with the tackiness of the removable adhesive inside the valve forces the valve shut and keeps it closed until the balloon is refilled, again forcing the same chain of events.

The valve according to the present invention can be inserted into balloon neck portions and bodies in an in-line manufacturing operation wherein the preformed and heat sealed valve is tack bonded to one moving balloon sheet at one end and fed along with the two sheets of balloon wall material to a heat sealing and cutting station which forms the balloon and forms the balloon neck-valve seal. Adhesive seal means can be located at almost any position between the inlet opening and the outlet opening at the inlet and outlet ends. In general, the in-line manufacturing process positions the value substantially throughout the lengths of the balloon neck portion or stem, as well as presenting a substantial portion of the valve extending into the balloon body. In general, only one valve to balloon neck seal is required in order to seal the inflated balloon through the function of the self-sealing valve. However, more than one seal could be utilized in balloons of substantial size requiring greater balloon neck and valve dimensions.

What has been described as a self-sealing, refillable plastic balloon valve is one which permits the inflation of a variety of inflatable bodies constructed of plastic-type materials and yet is one which does not permit the escape of any fluid such as air or gas after the inflation is completed and the inflating pressure is withdrawn from the valve. The valve is a self-sealing plastic balloon valve which does not require any external pressure to perfect the seal. Instead, the seal is made by the increased pressure within the inflated article, forcing the walls of the flexible elongated balloon valve together or in the alternative, forcing an adhesive element mounted on one wall into contact with another wall to form the seal. The elongated balloon valve also provides for a channel portion which has an internal non-sealable coating suitable for positioning in a balloon neck portion wherein, for example, the elongated balloon valve is heat sealed to the balloon neck portion, however, due to the non-sealable coating, the channel between the inlet opening and the outlet opening of the valve is not closed. The heat seal, for example, of the plastic balloon valve to the interior neck portion of the balloon provides a fluid seal other than the channel of the balloon valve which self-seals upon back pressure compression.

Preferred embodiments of the present invention have been described herein. It is to be understood that modifications and changes can be made without departing from the true scope and spirit of the present invention, which are defined by the following claims to be interpreted in view of the foregoing description.

What is claimed is:

1. A self-sealing balloon valve capable of multiple self-sealing and refillable cycles, for use with a non-latex balloon having a neck portion and a body, said valve comprising:

an elongated, flexible plastic valve, the valve formed by register and overlay of at least two sheets of flexible plastic material of equal length having sealed edges, said flexible plastic sheets being formed to define a two sided valve channel from an inlet end portion to an outlet end poriton, said inlet end poriton being sealed at its outermost end and having an inlet opening in one side of the valve for fluid intake, said inlet opening being positioned inwardly from the outermost sealed end of the inlet portion end, and said outlet end poriton having an outlet opening;

the valve channel having at least one interior surface portion coated with a non-sealable material which prevents the sheets from sealing together and closing the channel when the valve is positioned and heat sealed onto the neck portion of the balloon, said non-sealable material extending longitudinally and inwardly from the inlet opening;

the valve having at least one self-sealing means along the channel between the inlet opening and outlet opening comprised of a coating of a reusable adhesive element to at least one of the interior surfaces of the said channel which, when compressed together, seals said channel interior surfaces, the adhesive seal capable of multiple reopen and closure modes between the adhesive element and the opposite interior channel surface;

the self-sealing means being adapted to be sealed by filled fluid pressure from the balloon upon withdrawal of fill pressure from the valve.

2. The valve of claim 1 wherein said valve is adapted to be positioned and secured in the neck portion of a balloon and said inlet opening of the valve is positioned in the outer end of the neck portion and the outlet end of the valve is positioned in the body of the balloon.

3. The self-sealing balloon valve according to claim 1 wherein the adhesive is comprised of a resin emulsion water-based adhesive.

4. The self-sealing balloon valve according to claim 1 wherein the adhesive is comprised of a distilled monoglyceride-based adhesive.

5. A self-sealing balloon valve capable of multiple self-sealing and refillable cycles, for use with a non-latex balloon having a neck portion and a body, said valve comprising:

an elongated, flexible plastic valve, the valve formed by register and overlay of at least two sheets of flexible plastic material of equal length having sealed edges, said flexible plastic sheets being formed to define a two sided valve channel from an inlet end portion to an outlet end portion, said inlet end portion being sealed at its outermost end and having an inlet opening in one side of the valve for fluid intake, said inlet opening being positioned inwardly from the outermost sealed end of the inlet portion end, and said outlet end portion having an outlet opening;

the valve channel having at least one interior surface portion coated with a non-sealable material which prevents the sheets from sealing together and closing the channel when the valve is positioned and heat sealed onto the neck portion of the balloon, said non-sealable material extending longitudinally and inwardly from the inlet opening;

the valve having at least one self-sealing means along the channel between the inlet opening and outlet opening, said self-sealing means comprising a tapered restriction channel forming a zone of reduced cross-sectional opening which allows the valve to self-seal through a creasing action near the outlet end portion, said zone of reduced cross-sectional opening being positioned between the inlet end portion and the outlet end portion wherein the channel cross-section is reduced providing additional self-sealing means upon compression;

the self-sealing means being adapted to be sealed by filled fluid pressure from the balloon upon withdrawal of fill pressure from the valve.

6. The valve of claim 5 wherein said valve is adapted to be positioned and secured in the neck portion of the balloon and said inlet opening of the valve is positioned in the outer end of the neck portion and the outlet end is positioned in the body of the balloon.

7. A self-sealing balloon valve capable of multiple self-sealing and refillable cycles, for use with a non-latex balloon having a neck portion and a body, said valve comprising:

an elongated, flexible plastic valve, the valve formed by register and overlay of at least two sheets of flexible plastic material of equal length having sealed edges, said flexible plastic sheets being formed to define a two sided valve channel from an inlet end portion to an outlet end portion, said inlet end portion being sealed at its outermost end and having an inlet opening in one side of the valve for fluid intake, said inlet opening being positioned inwardly from the outermost sealed end of the inlet portion end for direct fluid intake, and said outlet end portion having an outlet opening;

the valve channel having at least one interior surface portion coated with a non-sealable material which prevents the sheets from sealing together and closing the channel when the valve is positioned and heat sealed onto the neck portion of the balloon, said non-sealable material extending longitudinally and inwardly from the inlet opening;

the valve having a first and second self-sealing means along the channel between the inlet opening and outlet opening, said first self-sealing means comprising a tapered restriction channel forming a zone of reduced cross-sectional opening which allows the valve to self-seal through a creasing action near the outlet end portion, said zone of reduced cross-sectional opening being positioned between the inlet end portion and the outlet end portion wherein the channel cross-section is reduced providing additional self-sealing means upon compression, said second self-sealing means comprising a coating of a reusable adhesive element to at least one of the interior surfaces of the said channel which, when compressed together, seals said channel interior surfaces, the adhesive seal capable of multiple reopen and closure modes between the adhesive element and the opposite interior channel surface;

the self-sealing means being adapted to be sealed by filled fluid pressure from the balloon upon withdrawal of fill pressure from the valve.

8. The valve of claim 7 wherein said valve is adapted to be positioned and secured in the neck portion of the balloon and said inlet opening of the valve is positioned in the outer end of the neck portion and the outlet end is positioned in the body of the balloon.

9. The self-sealing balloon valve according to claim 7 wherein the adhesive is comprised of a resin emulsion water-based adhesive.

10. The self-sealing balloon valve according to claim 7 wherein the adhesive is comprised of a distilled monoglyceride-based adhesive.

* * * * *